US009086656B2

(12) United States Patent
Ochi et al.

(10) Patent No.: US 9,086,656 B2
(45) Date of Patent: Jul. 21, 2015

(54) IMAGE FORMING APPARATUS AND DEVELOPING DEVICE

(71) Applicant: FUJI XEROX CO., LTD., Tokyo (JP)

(72) Inventors: Takashi Ochi, Kanagawa (JP); Yoshitaka Nakajima, Kanagawa (JP); Ryota Tomishi, Kanagawa (JP); Shota Oba, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/164,729

(22) Filed: Jan. 27, 2014

(65) Prior Publication Data

US 2015/0003879 A1 Jan. 1, 2015

(30) Foreign Application Priority Data

Jun. 26, 2013 (JP) ..... 2013-133675

(51) Int. Cl.
*G03G 15/09* (2006.01)
*G03G 15/08* (2006.01)

(52) U.S. Cl.
CPC ..... *G03G 15/09* (2013.01); *G03G 15/0891* (2013.01); *G03G 15/0808* (2013.01)

(58) Field of Classification Search
USPC ..... 399/111, 119, 252, 265, 267, 272–277, 399/281–284
See application file for complete search history.

(56) References Cited

U.S. PATENT DOCUMENTS 5,239,343 A * 8/1993 Sakemi et al. ..... 399/275

FOREIGN PATENT DOCUMENTS

| | | |
|---|---|---|
| JP | A-2001-17857 | 1/2001 |
| JP | A-2001-281997 | 10/2001 |
| JP | A-2002-258605 | 9/2002 |

* cited by examiner

*Primary Examiner* — Hoan Tran
(74) *Attorney, Agent, or Firm* — Oliff PLC

(57) ABSTRACT

An image forming apparatus includes an image carrier, a developer container, a moving mechanism that moves a toner of a developer to the image carrier, a stirring and transporting member that transports the developer in the developer container to the moving mechanism, a layer thickness regulating member that regulates the layer thickness of the developer held by a developer holder of the moving mechanism, and a movement regulating unit that regulates movement of the developer. An end of the movement regulating unit at a stirring and transporting member side is located at the stirring and transporting member side with respect to a tangent line tangent to the outer circumference of the stirring and transporting member and passing through a position where the density of magnetic flux of an attraction magnetic pole of a magnet member of the moving mechanism on the surface of the developing holder is the highest.

8 Claims, 9 Drawing Sheets

IMAGE FORMING APPARATUS AND DEVELOPING DEVICE

CROSS-REFERENCE TO RELATED APPLICATIONS

This application is based on and claims priority under 35 USC 119 from Japanese Patent Application No. 2013-133675 filed Jun. 26, 2013.

BACKGROUND

Technical Field

The present invention relates to an image forming apparatus and a developing device.

SUMMARY

According to an aspect of the invention, there is provided an image forming apparatus including an image carrier that carries an image; a developer container that stores a developer containing a toner and a carrier; and a moving mechanism that moves the toner of the developer stored in the developer container to the image carrier. The moving mechanism includes a magnet member that includes plural magnetic poles, and a developer holder that is formed of a non-magnetic material, rotates around the magnet member, and holds the developer. The plural magnetic poles include an attraction magnetic pole that attracts the developer to a surface of the developer holder. The image forming apparatus further includes a stirring and transporting member that stirs the developer stored in the developer container and transports the developer to the moving mechanism; a layer thickness regulating member that regulates a layer thickness of the developer held by the developer holder; and a movement regulating unit that regulates movement of the developer toward the developer holder. The movement regulating unit has an end at a stirring and transporting member side, the end being located at the stirring and transporting member side with respect to a tangent line which is tangent to an outer circumference of the stirring and transporting member and which passes through a position where a density of magnetic flux of the attraction magnetic pole on the surface of the developing holder is the highest.

BRIEF DESCRIPTION OF THE DRAWINGS

Exemplary embodiments of the present invention will be described in detail based on the following figures, wherein.

DETAILED DESCRIPTION

Figure 1:
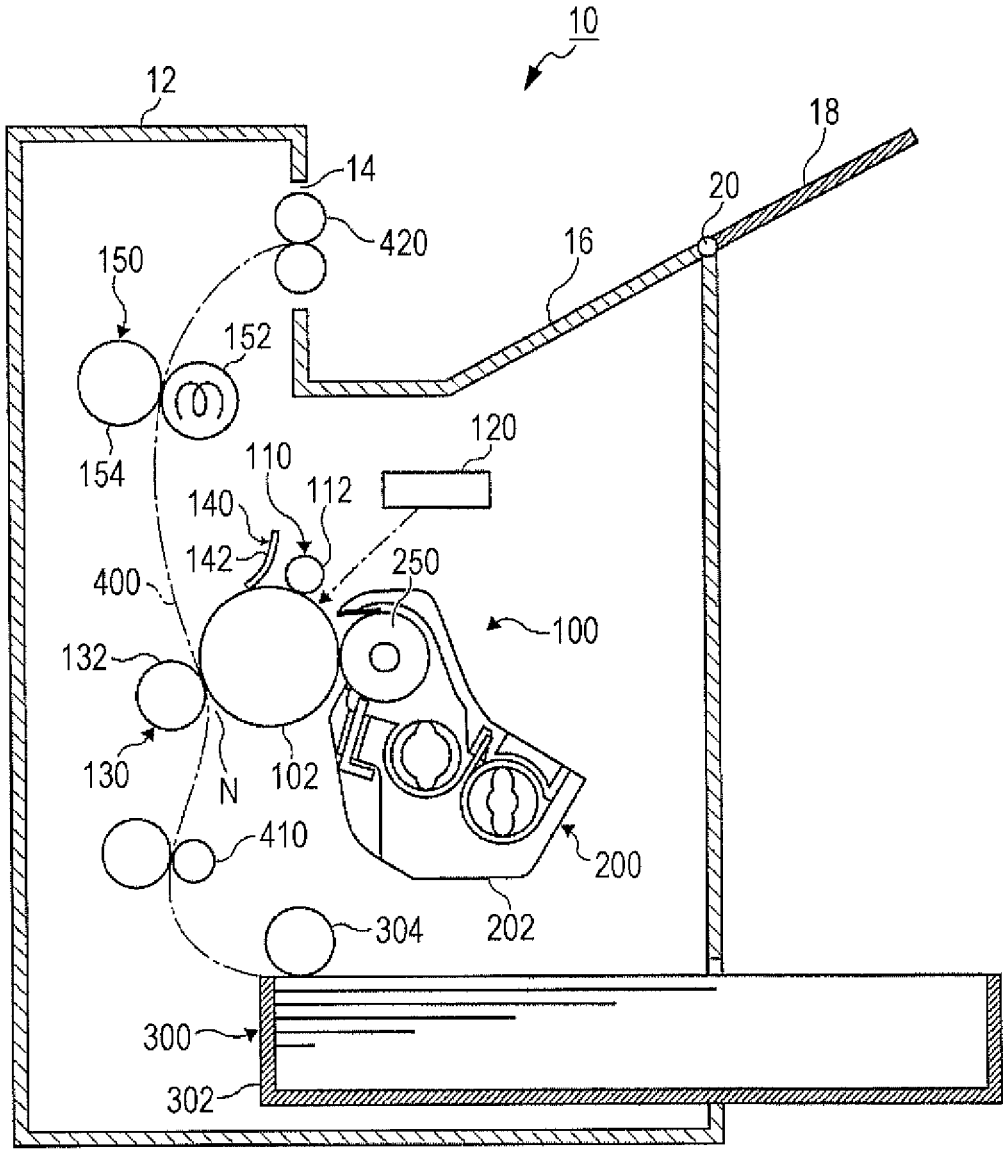
FIG. 1 illustrates an image forming apparatus according to a first exemplary embodiment of the present invention.

FIG. 1 illustrates an image forming apparatus 10 according to a first exemplary embodiment of the present invention. As shown in FIG. 1, the image forming apparatus 10 includes an image forming apparatus body 12. An image forming unit 100 and a paper feeder 300 are provided in the image forming apparatus body 12. Further, a transport path 400 for transporting paper serving as a recording medium is formed in the image forming apparatus body 12.

An ejection opening 14 for ejecting paper is formed in the image forming apparatus body 12. The upper surface of the image forming apparatus body 12 serves as an ejection section 16. Paper is ejected from the image forming apparatus body 12 into the ejection section 16 through the ejection opening 14. Further, a support plate 18 is attached to the image forming apparatus body 12.

The support plate 18 is a member that supports, together with the ejection section 16, paper ejected from the image forming apparatus body 12. The support plate 18 is attached to the image forming apparatus body 12 so as to be rotatable about a hinge 20.

The image forming unit 100 forms a monochrome image, for example, and uses an electrophotographic system. The image forming unit 100 includes a photoconductor 102 serving as an image carrier that carries an image, a charging device 110 that charges the photoconductor 102, a latent image forming device 120 that irradiates with light the surface of the photoconductor 102 charged by the charging device 110 so as to form an electrostatic latent image on the surface of the photoconductor 102, a developing device 200 that develops the latent image formed on the photoconductor 102, using a developer containing a toner, so as to form a toner image on the surface of the photoconductor 102, a transfer device 130 that transfers the toner image formed on the surface of the photoconductor 102 by the developing device 200 to paper, a cleaning device 140 that cleans the photoconductor 102 after the toner image is transferred to the paper by the transfer device 130, and a fixing device 150 that fixes the toner image, which is transferred to the paper by the transfer device 130, to the paper.

The charging device 110 includes a charging member 112. The charging member 112 has, for example, the shape of a roller, and is disposed in contact with or in proximity to the photoconductor 102. A DC charging voltage or an AC-superimposed DC charging voltage is applied to the charging member 112 from a power supply (not shown) so as to charge the photoconductor 102.

The developing device 200 is a so-called two-component developing device that develops a latent image using a developer containing a toner and a carrier. For example, a developer containing a negatively-chargeable non-magnetic toner, a positively-chargeable magnetic carrier, and the like, is used. The developing device 200 includes a developing device body 202 serving as a developer container that stores the developer, and a toner moving mechanism 250 that is attached to the developing device body 202 and transports the toner of the developer stored in the developing device body 202 to the photoconductor 102. The details of the developing device 200 will be described below.

The transfer device 130 includes a transfer member 132. The transfer member 132 has, for example, the shape of a roller, and is disposed in contact with the photoconductor 102. A transfer voltage is applied from a power supply (not shown) to the transfer member 132.

The cleaning device 140 includes a cleaning member 142. The cleaning member 142 is a plate member, for example. The cleaning member 142 has an end pressed against the photoconductor 102 such that the pressed end removes toner and the like from the surface of the photoconductor 102 so as to clean the photoconductor 102.

The fixing device 150 includes a heating roller 152 having a heat source therein, a pressure roller 154 that is in contact with the heating roller 152. The toner transferred to the paper is heated and pressed at a contact portion between the heating roller 152 and the pressure roller 154 such that the toner image is fixed to the paper.

The paper feeder 300 feeds paper to the image forming unit 100. The paper feeder 300 includes a paper tray 302 in which sheets of paper are stored in a stack, and a feeding roller 304 that feeds the paper from the paper tray 302.

The transport path 400 is a transport path for transporting the paper from the paper feeder 300 to the transfer device 130, transporting the paper from the transfer device 130 to the fixing device 150, and then ejecting the paper from the image forming apparatus body 12. In the vicinity of the transport path 400, there are disposed the feeding roller 304, registration rollers 410, the transfer device 130, the photoconductor 102, the fixing device 150, and ejection rollers 420 along the transport path 400 in this order from the upstream side in the paper transport direction.

The registration rollers 410 temporarily stop the movement of the leading edge of the paper being transported toward a contact position N where the photoconductor 102 and the transfer member 132 are in contact, and restarts the movement of the leading edge of the paper toward the contact position N such that the a toner image is formed thereon by the photoconductor 102 at a correct timing.

Figure 2:
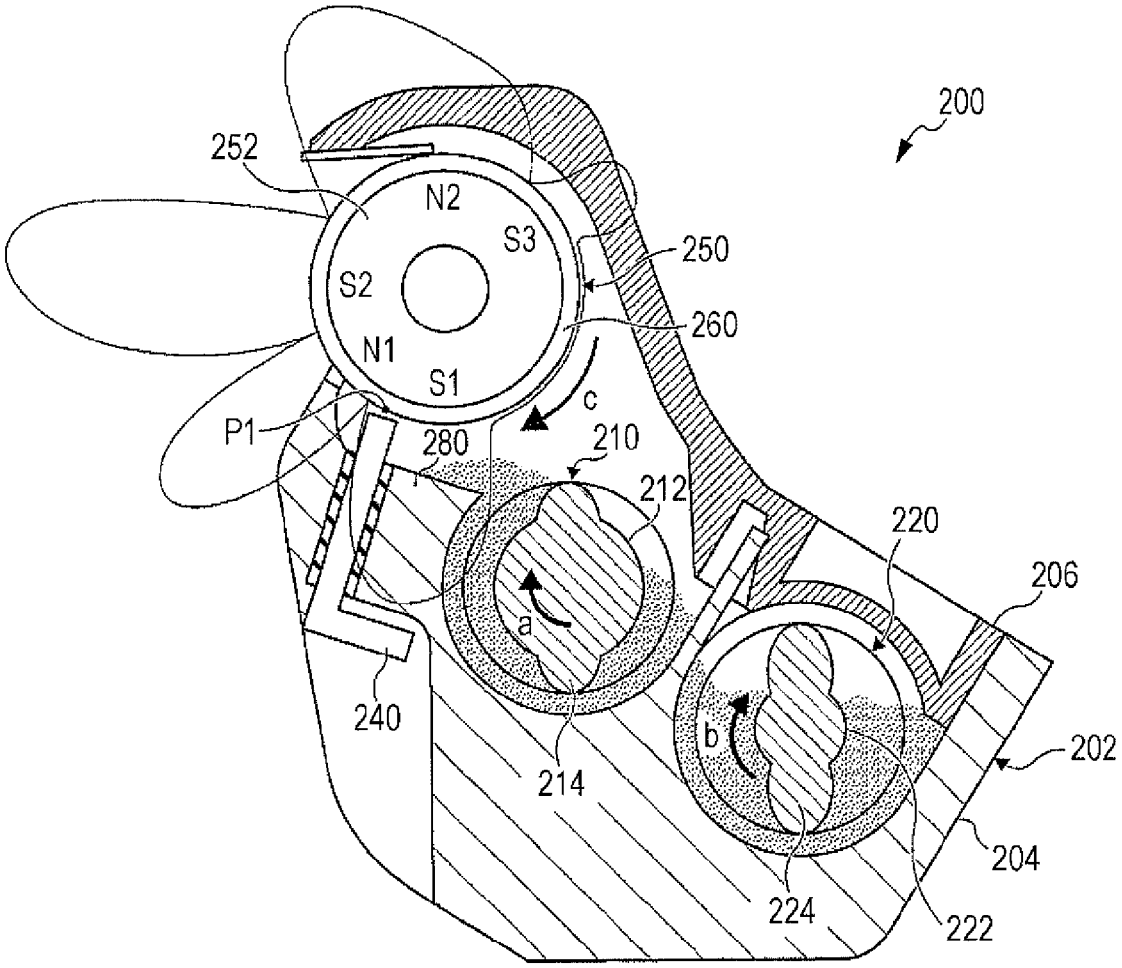
FIG. 2 illustrates a developing device of the image forming apparatus of FIG. 1.

FIG. 2 illustrates the developing device 200. As mentioned above, the developing device 200 includes the developing device body 202 and the toner moving mechanism 250. The toner moving mechanism 250 includes a magnet member 252, and a developing sleeve 260. The details of the magnet member 252 and the developing sleeve 260 will be described below.

The developing device body 202 includes a lower body 204 located downward, and a lid member 206 that is attached to the lower body 204 so as to cover an opening formed at the upper side of the lower body 204. An opening (not shown) for communication between the outside and inside of the developing device body 202 is formed, for example, in the lid member 206 of the developing device body 202. Toner is supplied from a toner container (not shown) to the developing device body 202 through this opening.

Further, the developing device 200 includes a layer thickness regulating member 240 that regulates the thickness of the developer attracted to the surface of the developing sleeve 260. The layer thickness regulating member 240 is attached to the developing device body 202 such that a predetermined gap is formed between an end thereof at the developing sleeve 260 side and the developing sleeve 260.

Further, the developing device 200 includes a stirring and transporting member 210 that stirs the developer stored in the developing device body 202, and transports the developer to the toner moving mechanism 250. The stirring and transporting member 210 includes a shaft 212 and a blade 214 that is helically formed on the outer periphery of the shaft 212. The shaft 212 and the blade 214 rotate together in the direction indicated by the arrow a of FIG. 2. Thus, the blade 214 presses the developer so as to stir the developer and transport the developer in the developing device body 202.

The stirring and transporting member 210 transports the developer in the longitudinal direction of the stirring and transporting member 210 (the direction perpendicular to the paper surface of FIG. 2) and moving the toner toward the toner moving mechanism 250 (from the right to the left in FIG. 2). Regarding the direction of transporting the developer, the right side in FIG. 2 is hereinafter referred to as an "upstream side", and the left side in FIG. 2 is hereinafter referred to as a "downstream side".

When the stirring and transporting member 210 transports the developer from the upstream side to the downstream side, that is, toward the developing sleeve 260, the pressure applied to a position P1 of the developing sleeve 260 facing the layer thickness regulating member 240 by the developer transported from the stirring and transporting member 210 might vary in accordance with the phase of rotation of the stirring and transporting member 210. That is, as the blade 214 comes close to the developing sleeve 260, the force applied to the position P1 by the supplied developer might increase. Further, as the blade 214 goes away from the developing sleeve 260, the force applied to the position P1 by the supplied developer might decrease. Then, when the pressure applied to the position P1 by the developer varies, the density of the developer attracted to the developing sleeve 260 becomes non-uniform. This might result in a reduction in the quality of the final image, such as generation of spots.

Further, the developing device 200 includes a stirring and transporting member 220. The stirring and transporting member 220 includes a shaft 222 and a blade 224 that is helically formed on the outer periphery of the shaft 222. The shaft 222 and the blade 224 rotate together in the direction indicated by the arrow b of FIG. 2. Thus, the blade 224 presses the developer so as to stir the developer and transport the developer in the developing device body 202. More specifically, the stirring and transporting member 220 transports the developer in the longitudinal direction of the stirring and transporting member 220. The stirring and transporting member 220 and the above-described stirring and transporting member 210 stir and transport the developer in the developing device body 202, so that the toner of the developer comes into friction contact with the carrier and the like, and is charged due to the friction with the carrier and the like.

The developing sleeve 260 is formed of a non-magnetic material, and serves as a developer holder that rotates around the magnet member 252 and holds the developer on the outer surface thereof. The developing sleeve 260 has a cylindrical shape, for example. Further, the developing sleeve 260 is connected to a motor or the like (not shown) serving as a drive source, through a driving force transmission mechanism (not shown) including a gear train, for example. The driving force is transmitted from the motor or the like through the driving force transmission mechanism, so that the developing sleeve 260 rotates in the direction indicated by the arrow c of FIG. 2.

The magnet member 252 has the shape of a column, for example, and includes plural magnetic poles extending in the longitudinal direction of the magnet member 252. More specifically, the magnet member 252 includes five magnetic poles S1, N1, S2, N2, and S3. The magnetic pole S1 serves as an attraction magnetic pole for attracting the developer to the surface of the developing sleeve 260. The above-mentioned layer thickness regulating member 240 is disposed such that the end at the developing sleeve 260 side is in a range within reach of the magnetic force of the magnetic pole S1. Therefore, out of the developer attracted to the developing sleeve 260 by the magnetic force of the magnetic pole S1, developer that has not been allowed to pass through the gap between the developing sleeve 260 and the layer thickness regulating member 240 is removed from the surface of the developing sleeve 260 by the layer thickness regulating member 240. Thus, the layer thickness of the developer attracted to the developing sleeve 260 is regulated.

The magnetic pole N1 is disposed downstream of the magnetic pole S1 in the rotational direction of the developing sleeve 260. The magnetic pole N1 serves as a transport magnetic pole that transports the developer by the rotation of the developing sleeve 260, by keeping the developer attracted to the surface of the developing sleeve 260. The magnetic pole S2 is disposed downstream of the magnetic pole N1 in the rotational direction of the developing sleeve 260. The magnetic pole S2 serves as a developing magnetic pole disposed in the vicinity of a movement region where the toner is moved from the surface of the developing sleeve 260 to the photoconductor 102 (see FIG. 1). Further, the magnetic pole N2 is disposed downstream of the magnetic pole S2 in the rotational direction of the developing sleeve 260. Similar to the magnetic pole N1 described above, the magnetic pole N2 serves as a transport magnetic pole that transports the developer by the rotation of the developing sleeve 260, by keeping the developer attracted to the surface of the developing sleeve 260. Further, the magnetic pole S3 is disposed downstream of the magnetic pole N2 in the rotational direction of the developing sleeve 260. The magnetic pole S3 serves as a separation magnetic pole disposed in the vicinity of a separation position where the developer is separated from the surface of the developing sleeve 260.

Further, the developing device 200 includes a movement regulating unit 280 that regulates the movement of the developer toward the developing sleeve 260. In the first exemplary embodiment, the movement regulating unit 280 is formed as an integral unit of the developing device body 202. However, instead of being formed as an integral unit of the developing device body 202, the developing device body 202 and the movement regulating unit 280 may be provided as separate units such that the movement regulating unit 280 may be attached to the developing device body 202. The details of the movement regulating unit 280, such as the position where the movement regulating unit 280 is disposed in the developing device body 202, will be described below.

In FIG. 2, the thin line indicates the position where the vertical component of the magnetic field formed by each of the magnetic poles S1, N1, S2, N2 and S3 of the magnet member 252 with respect to the surface of the developing sleeve 260 is 20 mT.

Figure 3:
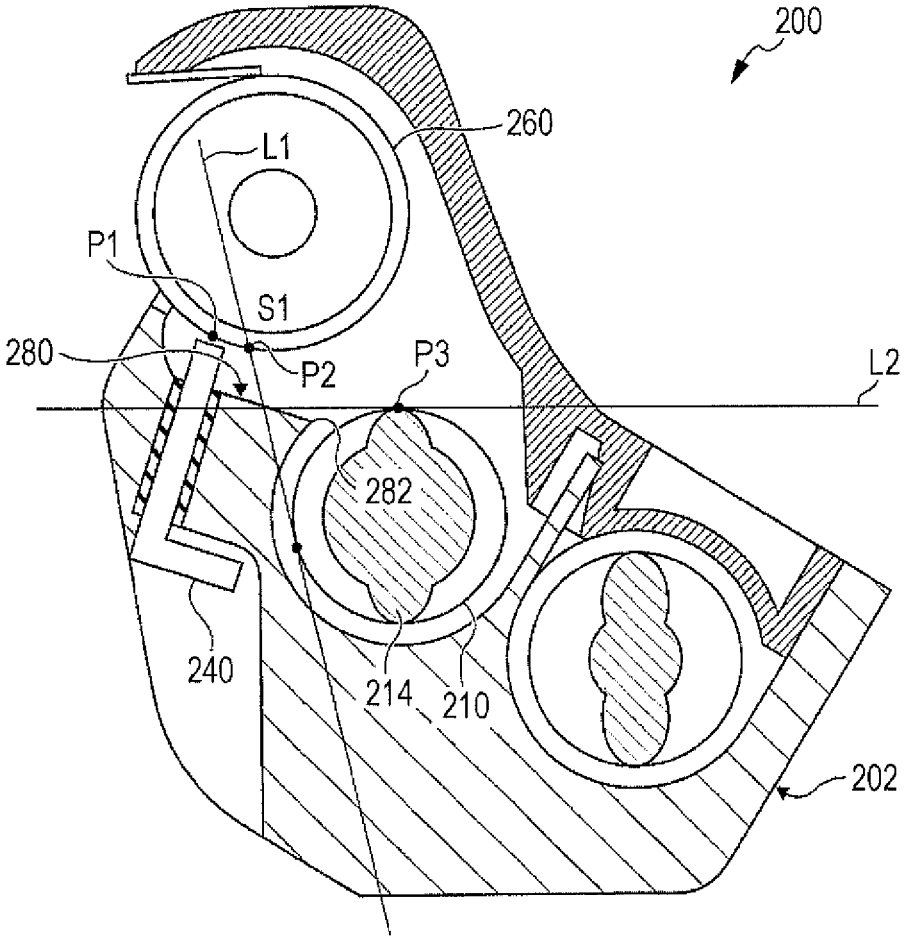
FIG. 3 illustrates the position where a movement regulating unit is disposed in the developing device of FIG. 2.

FIG. 3 illustrates the position where the movement regulating unit 280 is disposed in the developing device body 202. As shown in FIG. 3, in the cross-sectional view of the developing device 200, reference numeral P2 denotes a position where the density of magnetic flux of the magnetic pole S1 on the surface of the developing sleeve 260 is the highest, and reference numeral 282 denotes an end of the movement regulating unit 280 at the stirring and transporting member 210 side. Further, a virtual line L1 is a tangent line which is tangent to the outer circumference of the stirring and transporting member 210 and which passes through the position P2. In this case, the movement regulating unit 280 is disposed such that the end 282 is located at the stirring and transporting member 210 side (the right side in FIG. 3) with respect to the virtual line L1.

Since the movement regulating unit 280 is disposed in this position, the movement of the developer from the stirring and transporting member 210 toward the position P1 of the developing sleeve 260 facing the layer thickness regulating member 240 is regulated. This reduces a variation in the pressure applied from the developer to the position P1 in accordance with the phase of the rotation of the stirring and transporting member 210, that is, the position of the blade 214 of the stirring and transporting member 210.

Further, in the cross-sectional view of the developing device 200 of FIG. 3, a virtual line L2 is a horizontal line passing through a position P3 at the upper end of the stirring and transporting member 210. In this case, the end 282 is located below the virtual line L2. That is, the movement regulating unit 280 is disposed such that the end 282 is located below the position P3 at the upper end of the stirring and transporting member 210. Since the movement regulating unit 280 is disposed in this position, the movement of the developer from the stirring and transporting member 210 toward the position of the developing sleeve 260 attracting the developer is less likely to be prevented, and the transportation failure of the developer toward the developing sleeve 260 is less likely to occur.

Further, the movement regulating unit 280 is disposed such that the end 282 is located in an area where the vertical component of the magnetic field formed by the magnetic pole S1, serving as an attraction magnetic pole, with respect to the surface of the developing sleeve 260 is 20 mT or greater (see the thin line extending from the magnetic pole S1 to the outside of the developing sleeve 260 in FIG. 2).

Figure 4:
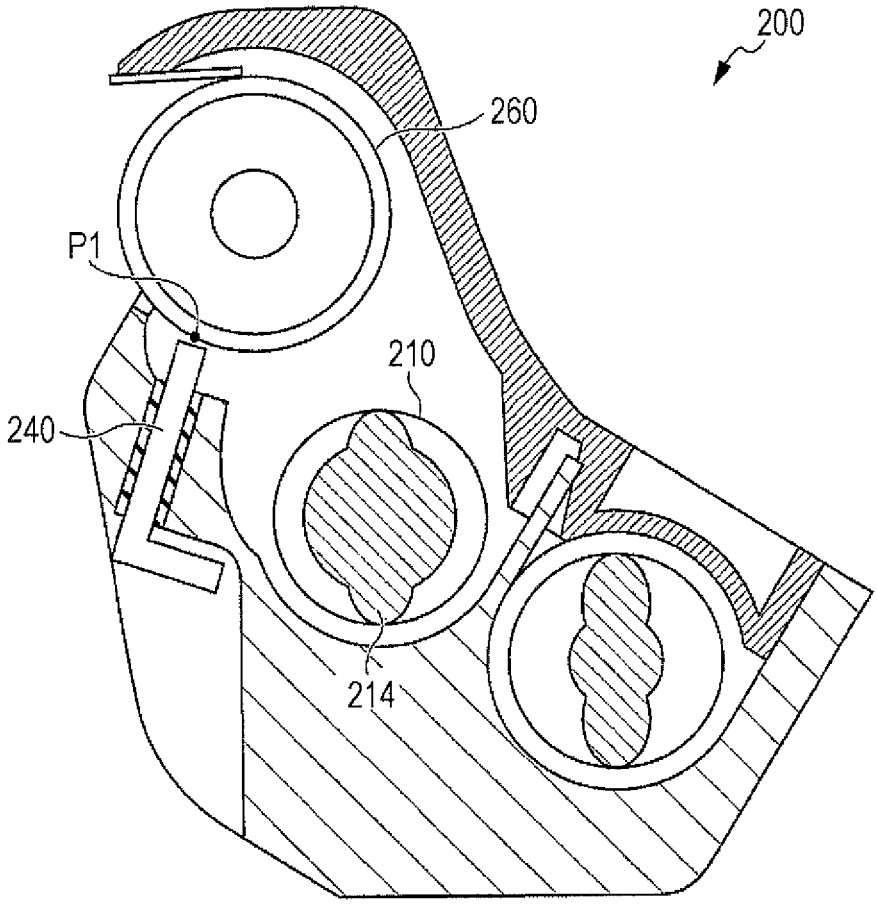
FIG. 4 illustrates a developing device according to a first comparative example.

FIG. 4 illustrates a developing device 200 according to a first comparative example. The developing device 200 of the image forming apparatus 10 of the above-described first exemplary embodiment of the present invention includes the movement regulating unit 280 (see FIGS. 2 and 3). On the other hand, the developing device 200 of the first comparative example does not include a movement regulating unit 280. Therefore, the movement of the developer from a stirring and transporting member 210 toward a position P1 of a developing sleeve 260 facing a layer thickness regulating member 240 is not regulated. Thus, it is highly likely that the pressure applied from the developer to the position P1 varies in accordance with the phase of the rotation of the stirring and transporting member 210, that is, the position of a blade 214 of the stirring and transporting member 210.

Figure 5:
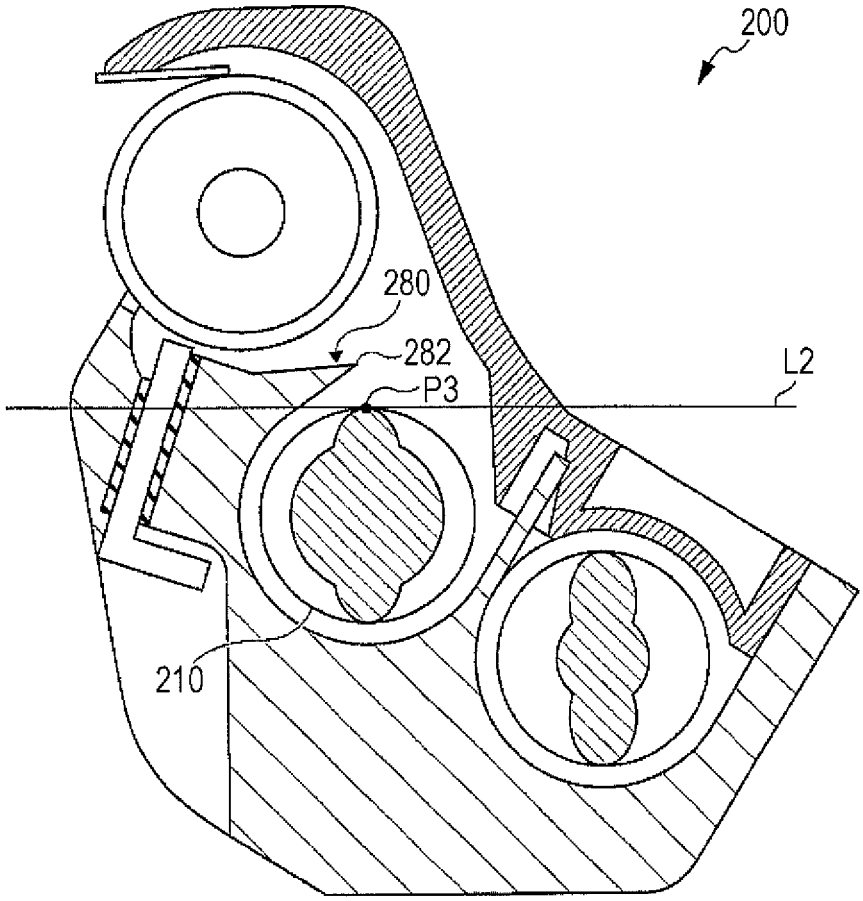
FIG. 5 illustrates a developing device according to a second comparative example.

FIG. 5 illustrates a developing device 200 according to a second comparative example. In the developing device 200 of the image forming apparatus 10 of the above-described first exemplary embodiment of the present invention, the end 282 of the movement regulating unit 280 at the stirring and transporting member 210 side is located below the virtual line L2 which is a horizontal line passing through the position P3 at the upper end of the stirring and transporting member 210. That is, in the first exemplary embodiment of the present invention, the movement regulating unit 280 is disposed such that the end 282 is located below the position P3 at the upper end of the stirring and transporting member 210. On the other hand, in the second comparative example, an end 282 of a movement regulating unit 280 at a stirring and transporting member 210 side is located above a virtual line L2. That is, in the second comparative example, the movement regulating unit 280 is disposed such that the end 282 is located above a position P3 at the upper end of the stirring and transporting member 210.

Therefore, in the second comparative example, the movement of the developer from the stirring and transporting member 210 toward a position of a developing sleeve 260 attracting the developer is prevented, and the transportation failure of the developer toward the developing sleeve 260 is likely to occur.

Figure 6:
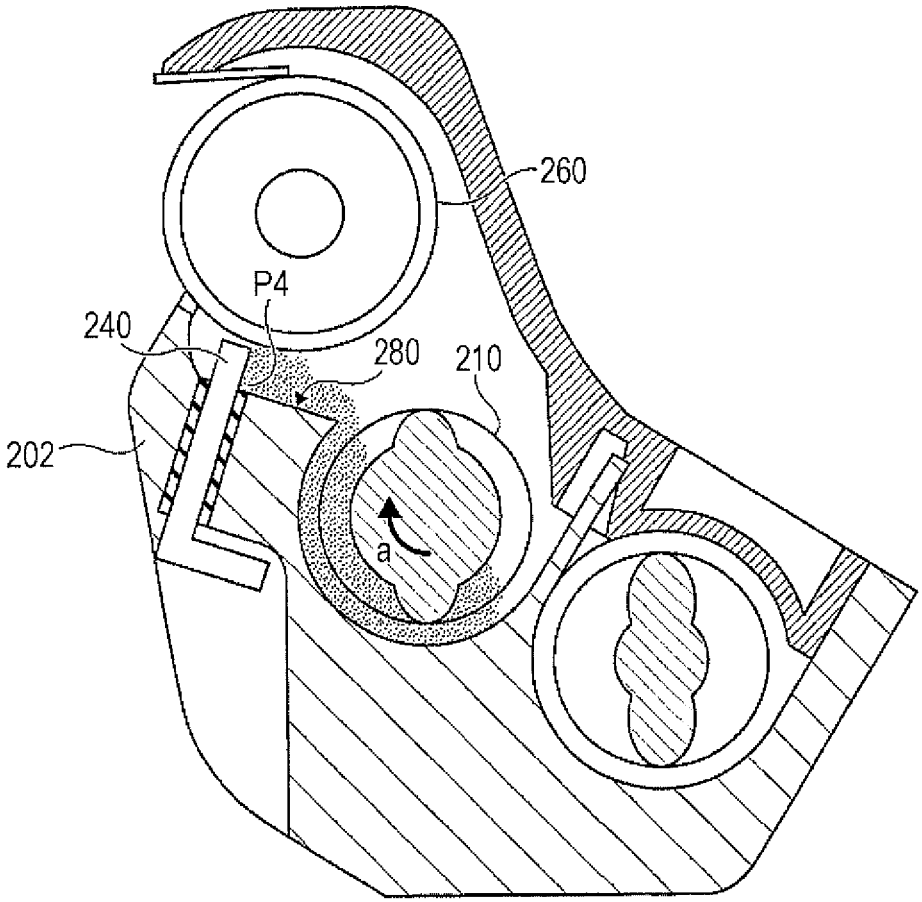
FIG. 6 illustrates the movement of developer in the developing device of FIG. 2.

FIG. 6 illustrates the developing device body 202 of the developing device 200 (see FIGS. 2 and 3) of the image forming apparatus 10 of the first exemplary embodiment of the present invention, in which the developer is being transported toward the developing sleeve 260 by the rotation of the stirring and transporting member 210 in the direction of the arrow a. Depending on the conditions including, for example, the physical properties of the developer (such as the viscosity) and the rotational speed of the stirring and transporting member 210, as shown in FIG. 6, the developer might be accumulated in a region between the developing sleeve 260 and the movement regulating unit 280, such as in a position P4 near the position where the layer thickness regulating member 240 protrudes from the developing device body 202, for example.

If the developer is accumulated in this way, the toner content of the accumulated developer might differ from the toner content of the developer that is subsequently transported toward the developing sleeve 260. For example, the toner content of the accumulated developer might be less than the toner content of the developer that is subsequently transported toward the developing sleeve 260. Then, if a latent image is formed on the photoconductor 102 using the accumulated developer whose toner content has been changed, there might be a reduction in the quality of the formed image, such as generation of white spots.

Figure 7:
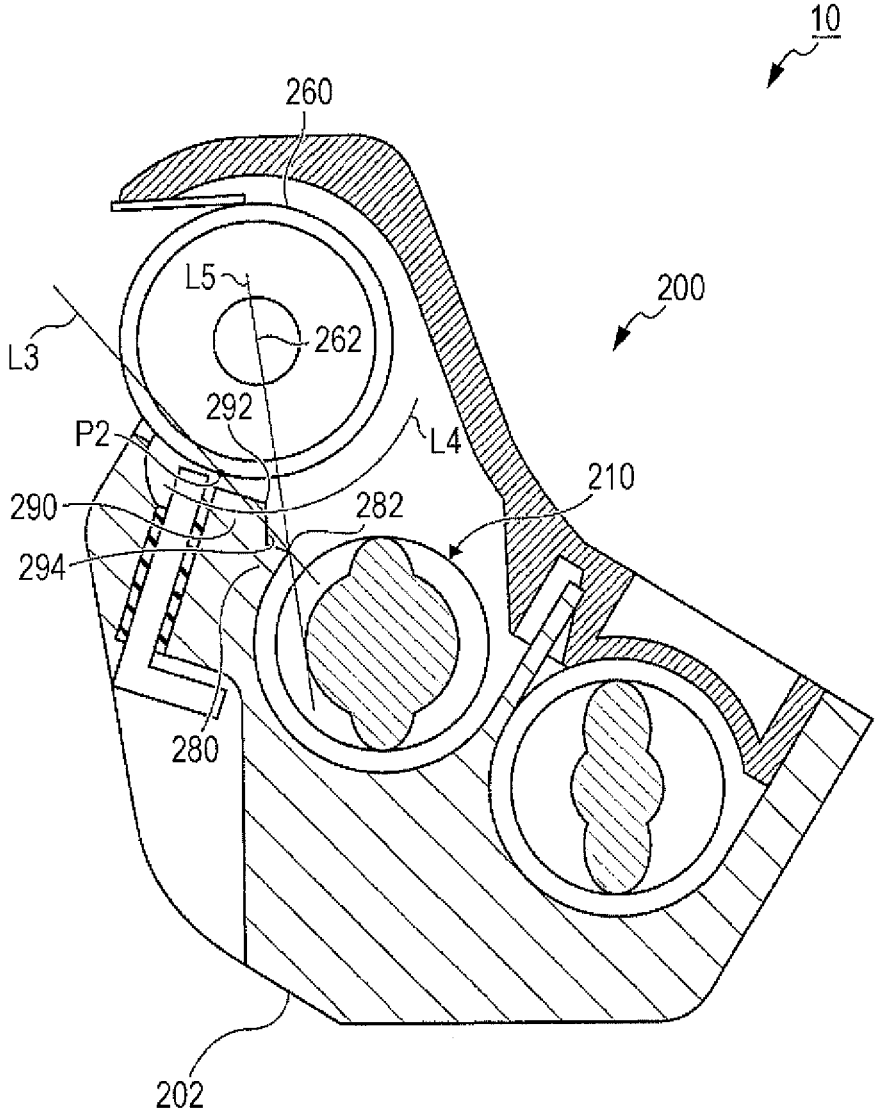
FIG. 7 illustrates a developing device according to a second exemplary embodiment of the present invention.

FIG. 7 illustrates a developing device 200 of an image forming apparatus 10 according to a second exemplary embodiment of the present invention. As shown in FIG. 7, the image forming apparatus 10 of the second exemplary embodiment includes an accumulation preventing unit 290 that prevents the developer from being accumulated between a developing sleeve 260 and a movement regulating unit 280, in addition to the components of the developing device 200 (see FIG. 2) of the above-described first exemplary embodiment. In the second exemplary embodiment, the accumulation preventing unit 290 is formed as an integral unit of the movement regulating unit 280 and a developing device body 202. Alternatively, the accumulation preventing unit 290 may be formed as a separate unit from the movement regulating unit 280 and the developing device body 202, and be attached to the developing device body 202, for example.

The accumulation preventing unit 290 is disposed such that, in the cross-sectional view of the developing device 200, an upper end 292 at a stirring and transporting member 210 side is located at the stirring and transporting member 210 side with respect to a virtual line L3. The virtual line L3 is a line connecting a position P2, in which the density of magnetic flux of a magnetic pole S1 on the surface of the developing sleeve 260 is the highest, and an end 282 of the movement regulating unit 280 at the stirring and transporting member 210 side. Therefore, the developer enters less easily between the developing sleeve 260 and the movement regulating unit 280, and the developer is less likely to be accumulated between the developing sleeve 260 and the movement regulating unit 280.

Further, a surface 294 of the accumulation preventing unit 290 including the upper end 292 and facing the stirring and transporting member 210 is flat, and no recess is formed in the surface 294. As long as no recess is formed in the surface 294, accumulation of the developer in a recess is prevented.

The accumulation preventing unit 290 is disposed such that, in the cross-sectional view of the developing device 200, the upper end 292 at the stirring and transporting member 210 side is located in the area where the vertical component of the magnetic field formed by the magnetic pole S1, serving as an attraction magnetic pole, with respect to the surface of the developing sleeve 260 is 20 mT or greater. Therefore, the developer that has been prevented by the upper end 292 from entering the space between the developing sleeve 260 and the movement regulating unit 280 and thus is present in the vicinity of the upper end 292 is easily attracted to the developing sleeve 260. A line L4 in FIG. 7 indicates the position where the vertical component of the magnetic field formed by the magnetic pole S1, serving as an attraction magnetic pole, with respect to the surface of the developing sleeve 260 is 20 mT.

Further, the accumulation preventing unit 290 is disposed such that, in the cross-sectional view of the developing device 200, the upper end 292 at the stirring and transporting member 210 side is located at the side opposite to the stirring and transporting member 210 with respect to a virtual line L5. The virtual line L5 is a line connecting the end 282 of the movement regulating unit 280 at the stirring and transporting member 210 side and a rotation center 262 of the developing sleeve 260. Therefore, the developer that has been prevented by the upper end 292 from entering the space between the developing sleeve 260 and the movement regulating unit 280 and thus is present in the vicinity of the upper end 292 is less likely to be prevented by the accumulation preventing unit 290 from moving toward the developing sleeve 260.

Figure 8:
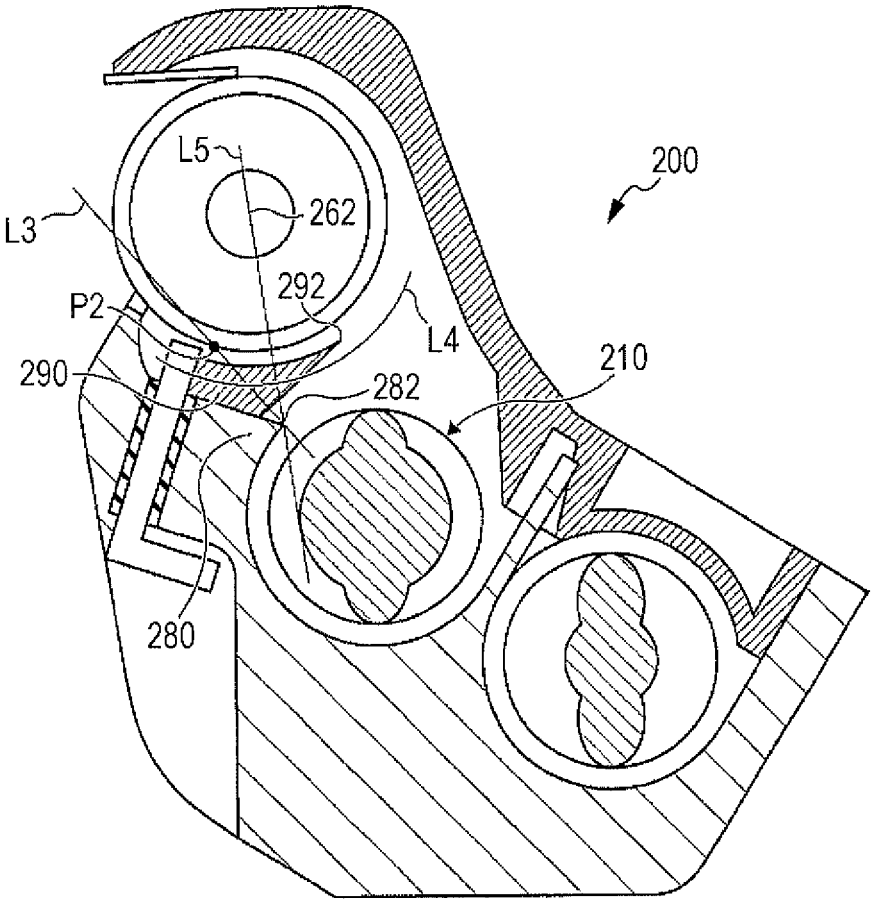
FIG. 8 illustrates a developing device according to a third comparative example.

FIG. 8 illustrates a developing device 200 according to a third comparative example. In the developing device 200 of the above-described second exemplary embodiment of the prevent invention, the accumulation preventing unit 290 is disposed such that, in the cross-sectional view of the developing device 200, the upper end 292 at the stirring and transporting member 210 side is located at the side opposite to the stirring and transporting member 210 with respect to the virtual line L5 connecting the end 282 of the movement regulating unit 280 at the stirring and transporting member 210 side and the rotation center 262 of the developing sleeve 260. On the other hand, in the third comparative example, an accumulation preventing unit 290 is disposed such that an upper end 292 at a stirring and transporting member 210 side is located at the same side as the stirring and transporting member 210 with respect to a virtual line L5. Therefore, in the third comparative example, the developer that has been prevented by the upper end 292 from entering the space between a developing sleeve 260 and a movement regulating unit 280 and thus is present in the vicinity of the upper end 292 is likely to be prevented by the accumulation preventing unit 290 from moving toward the developing sleeve 260.

Figure 9:
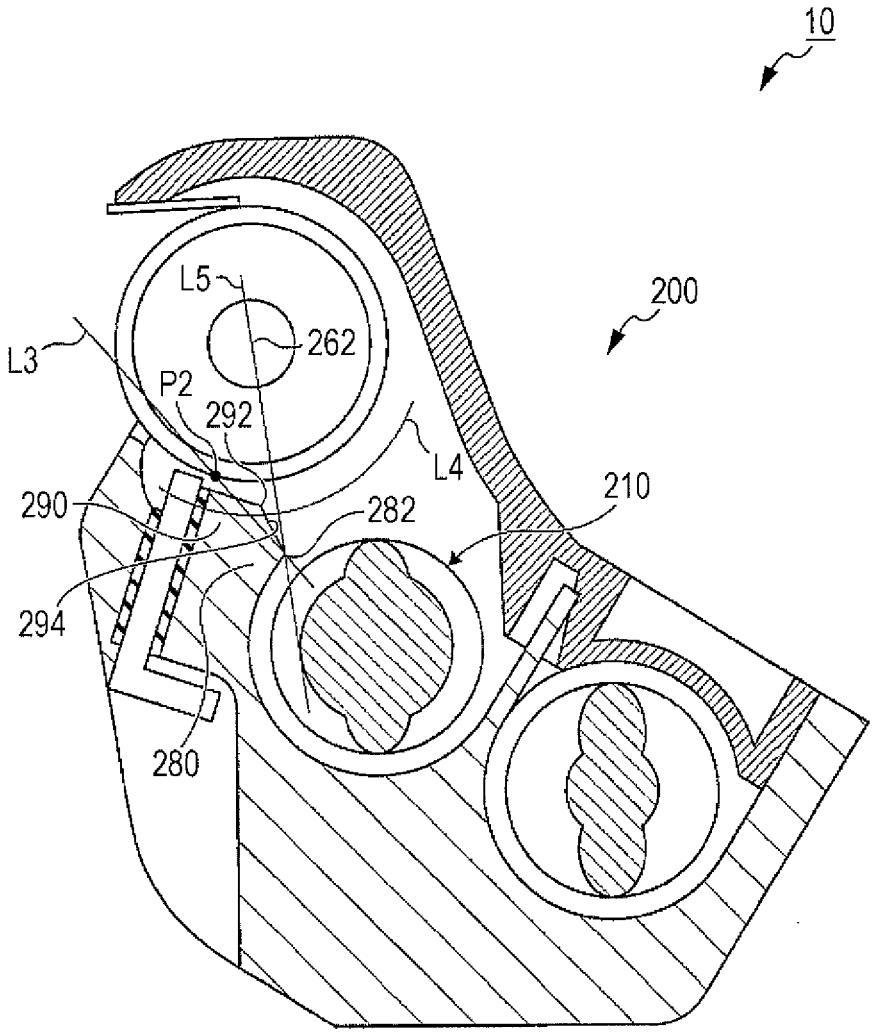
FIG. 9 illustrates a developing device according to a third exemplary embodiment of the present invention.

FIG. 9 illustrates a developing device 200 of an image forming apparatus 10 according to a third exemplary embodiment of the present invention. In the developing device 200 of the above-described second exemplary embodiment, the accumulation preventing unit 290 has such a shape that a step is formed between the upper end 292 of the accumulation preventing unit 290 and the end 282 of the movement regulating unit 280 (see FIG. 7). On the other hand, in the developing device 200 of the third exemplary embodiment, a movement regulating unit 280 and an accumulation preventing unit 290 are continuously formed so as not to form a step or a recess between an upper end 292 of the accumulation preventing unit 290 and an end 282 of the movement regulating unit 280. More specifically, in the developing device 200 of the third exemplary embodiment, the shape of the accumulation preventing unit 290 is determined such that a flat surface 294 including the upper end 292 and facing a stirring and transporting member 210 includes the end 282 of the movement regulating unit 280.

In the developing device 200 of the third exemplary embodiment, since no step is formed between the upper end 292 of the accumulation preventing unit 290 and the end 282 of the movement regulating unit 280, there is no risk of the developer being accumulated in a step between the upper end 292 of the accumulation preventing unit 290 and the end 282 of the movement regulating unit 280.

In the above-described exemplary embodiments, the image forming unit 100 that forms a monochrome image is illustrated. However, the present invention is applicable to an image forming unit that forms a multicolor image.

As described above, the present invention is applicable at least to an image forming apparatus such as a printer, a facsimile machine, and a copier, and to a developing device for use in such an image forming apparatus, for example.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries an image;

a developer container that stores a developer comprising a toner and a carrier;

a moving mechanism that moves the toner of the developer stored in the developer container to the image carrier, the moving mechanism including a magnet member that includes a plurality of magnetic poles, and a developer holder that is formed of a non-magnetic material, rotates around the magnet member, and holds the developer, wherein the plurality of magnetic poles include an attraction magnetic pole that attracts the developer to a surface of the developer holder;

a stirring and transporting member that stirs the developer stored in the developer container and transports the developer to the moving mechanism;

a layer thickness regulating member that regulates a layer thickness of the developer held by the developer holder; and a movement regulating unit that regulates movement of the developer toward the developer holder;

wherein the movement regulating unit has an end at a stirring and transporting member side, the end being located at the stirring and transporting member side with respect to a tangent line which is tangent to an outer circumference of the stirring and transporting member and which passes through a position where a density of magnetic flux of the attraction magnetic pole on the surface of the developing holder is the highest.

2. The image forming apparatus according to claim 1, wherein the end of the movement regulating unit is located below an upper end of the stirring and transporting member.

3. The image forming apparatus according to claim 1, wherein the end of the movement regulating unit at the stirring and transporting member side is located in an area where a vertical component of a magnetic field formed by the attraction magnetic pole with respect to the surface of the developing holder is 20 mT or greater.

4. The image forming apparatus according to claim 1, further comprising:

an accumulation preventing unit that prevents the developer from being accumulated between the developer holder and the movement regulating unit.

5. The image forming apparatus according to claim 4, wherein the accumulation preventing unit has an upper end at the stirring and transporting member side, the upper end being located at the stirring and transporting member side with respect to a line connecting a position where a density of magnetic flux of the attraction magnetic pole on the surface of the developing holder is the highest and the end of the movement regulating unit, and being located in an area where a vertical component of a magnetic field formed by the attraction magnetic pole with respect to the surface of the developing holder is 20 mT or greater.

6. The image forming apparatus according to claim 5, wherein the upper end of the accumulation preventing unit at the stirring and transporting member side is located at a side opposite to the stirring and transporting member with respect to a line connecting the end of the movement regulating unit at the stirring and transporting member side and a rotation center of the developing holder.

7. The image forming apparatus according to claim 4, wherein the movement regulating unit and the accumulation preventing unit are continuously formed.

8. A developing device comprising:

a developer container that stores a developer comprising a toner and a carrier and used for developing a latent image formed on an image carrier which carries an image;

a moving mechanism that moves the toner of the developer stored in the developer container to the image carrier, the moving mechanism including a magnet member that includes a plurality of magnetic poles, and a developer holder that is formed of a non-magnetic material, rotates around the magnet member, and holds the developer, wherein the plurality of magnetic poles include an attraction magnetic pole that attracts the developer to a surface of the developer holder;

a stirring and transporting member that stirs the developer stored in the developer container and transports the developer to the moving mechanism;

a layer thickness regulating member that regulates a layer thickness of the developer held by the developer holder; and a movement regulating unit that regulates movement of the developer toward the developer holder;

wherein the movement regulating unit has an end at a stirring and transporting member side, the end being located at the stirring and transporting member side with respect to a tangent line which is tangent to an outer circumference of the stirring and transporting member and which passes through a position where a density of magnetic flux of the attraction magnetic pole on the surface of the developing holder is the highest.

* * * * *